US008864515B2

(12) United States Patent
Oh

(10) Patent No.: US 8,864,515 B2
(45) Date of Patent: Oct. 21, 2014

(54) MULTIMEDIA JACK FOR VEHICLE PROVIDED WITH LIGHTING APPARATUS

(71) Applicants: Hyundai Motor Company, Seoul (KR); Kia Motors Corporation, Seoul (KR)

(72) Inventor: Se Min Oh, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 73 days.

(21) Appl. No.: 13/756,897

(22) Filed: Feb. 1, 2013

(65) Prior Publication Data

US 2014/0051280 A1 Feb. 20, 2014

(30) Foreign Application Priority Data

Aug. 16, 2012 (KR) ..... 10-2012-0089607

(51) Int. Cl.
*H01R 13/60* (2006.01)

(52) U.S. Cl.
USPC ..... 439/490; 439/910

(58) Field of Classification Search
USPC ..... 439/490, 910
See application file for complete search history.

(56) References Cited

U.S. PATENT DOCUMENTS

| | | | | |
|---|---|---|---|---|
| 5,915,993 | A * | 6/1999 | Belopolsky et al. | 439/490 |
| 6,257,906 | B1 * | 7/2001 | Price et al. | 439/131 |
| 6,336,825 | B1 * | 1/2002 | Seefried | 439/488 |
| 7,066,742 | B2 * | 6/2006 | Liang et al. | 439/76.1 |
| 7,479,032 | B2 * | 1/2009 | Hoath et al. | 439/540.1 |
| 7,758,369 | B2 * | 7/2010 | Miller et al. | 439/352 |
| 2003/0100217 | A1 * | 5/2003 | Wu | 439/490 |
| 2008/0032546 | A1 * | 2/2008 | Xuan et al. | 439/490 |
| 2009/0149061 | A1 * | 6/2009 | Zhang | 439/490 |
| 2009/0186531 | A1 * | 7/2009 | Hsu | 439/669 |
| 2009/0305549 | A1 * | 12/2009 | Liu | 439/490 |
| 2010/0317216 | A1 * | 12/2010 | Pocrass | 439/345 |
| 2011/0138905 | A1 | 6/2011 | Kim et al. | |
| 2011/0256758 | A1 * | 10/2011 | Sun | 439/490 |
| 2012/0034814 | A1 * | 2/2012 | Tseng et al. | 439/490 |
| 2012/0100748 | A1 * | 4/2012 | Sun | 439/490 |
| 2013/0273770 | A1 * | 10/2013 | Pong | 439/490 |

FOREIGN PATENT DOCUMENTS

| | | | |
|---|---|---|---|
| JP | 2006301212 | A | 11/2006 |
| JP | 2007151924 | A | 6/2007 |
| KR | 10-2000-0039038 | | 7/2000 |
| KR | 10-0419370 | | 2/2004 |
| KR | 10-2008-0072227 | | 8/2008 |
| KR | 10-0879128 | | 1/2009 |
| KR | 10-2009-0038233 | | 4/2009 |

(Continued)

*Primary Examiner* — Gary Paumen
(74) *Attorney, Agent, or Firm* — Edwards Wildman Palmer LLP; Peter F. Corless

(57) ABSTRACT

Disclosed herein is a multimedia jack for a vehicle with a lighting apparatus, including: a housing with an opening part; a terminal part, mounted on an inner side of the housing, with a multimedia port and a light emitting diode (LED) lighting apparatus; a cover part covering the opening part of the housing and including a connection receptacle disposed at a position corresponding to the multimedia port so as to be connected to the multimedia port; and a connection receptacle display part disposed around the connection receptacle, wherein light of the LED lighting apparatus is irradiated through the connection receptacle display part. Therefore, it is possible to increase user convenience at night by uniform lighting of the multimedia jack and control power and brightness by interworking with other apparatuses in the vehicle.

8 Claims, 6 Drawing Sheets

(56) References Cited

FOREIGN PATENT DOCUMENTS

| | | |
|---|---|---|
| KR | 1020090120877 | 11/2009 |
| KR | 10-2011-0010514 | 2/2011 |
| KR | 10-2011-0067184 | 6/2011 |

* cited by examiner

MULTIMEDIA JACK FOR VEHICLE PROVIDED WITH LIGHTING APPARATUS

CROSS-REFERENCE

This application is based on and claims priority from Korean Application No. 10-2012-0089607, filed on Aug. 16, 2012, the entire contents of which are incorporated herein by reference.

BACKGROUND OF THE INVENTION

1. Field of the Invention

The present invention relates to a multimedia jack for a vehicle having a lighting apparatus, and more particularly, to a multimedia jack for a vehicle increasing user convenience when operated at night by adding a lighting apparatus to an edge of a connection receptacle to connect a multimedia external device in the vehicle.

2. Description of the Prior Art

Conventionally known is a multimedia jack for connection of a multimedia external device in a vehicle, such as a universal serial bus (USB) port and an auxiliary (AUX) terminal. This conventional multimedia jack is illustrated in FIG. 1, which includes a body 100 having a USB port, an AUX terminal, a substrate; and a cover 200, protecting the body 100 from being damaged, with insertion receptacles 210 through which a user may connect the multimedia device to the USB port and the AUX terminal. The cover 200 includes a terminal display part 220 allowing the user to distinguish between the USB port and the AUX terminal. The multimedia jack, as described above, with a variety of ports and terminals may be easily distinguished by the user during the day, however, the multimedia jack lacks a separate lighting apparatus around the insertion receptacles 210 of the USB port and the AUX terminal allowing the ports and terminals to be easily distinguished by the user at night or in dark lighting.

Therefore, in order to overcome this problem, a separate lighting apparatus may be provided on the multimedia jack. However, adding a separate lighting apparatus may increase material costs, thereby increasing manufacturing costs.

As another alternative, to increase visibility of the multimedia jack at night, a lighting apparatus may be installed in the body 100 of the multimedia jack allowing light to leak through the insertion receptacles 210 or the terminal display part 220, illuminating terminals. FIG. 2 illustrates a light transmission form of the multimedia jack for a vehicle according to the related art. As shown in FIG. 2, direct light from the lighting apparatus in the body 100 leaks through the insertion receptacles 210 and the terminal display part 220, causing only a portion 210' of the insertion receptacle 210 and a portion 220' of the terminal display part to be illuminated. Therefore, some portions are bright and the other portions remain dark, such that lighting is not uniform.

SUMMARY OF THE INVENTION

The present invention provides a multimedia jack for a vehicle with a lighting apparatus distributing uniform light and controlling power and brightness of the apparatus by interworking with other apparatuses in the vehicle, thereby increasing user convenience when used at night.

One aspect of the present invention discloses a multimedia jack for a vehicle with a lighting apparatus, including: a housing having an opening part; a terminal part mounted at an inner side of the housing and including a multimedia port and a light emitting diode (LED) lighting apparatus; a cover part covering the opening part of the housing with a connection receptacle connected to the multimedia port; and a connection receptacle display part disposed around the connection receptacle, wherein light irradiated from the LED lighting apparatus shines through the connection receptacle display part. Therefore, a user may clearly distinguish the connection receptacle at night or in dark lighting by the light from the LED lighting apparatus shinning through the connection receptacle display part. The connection receptacle display part may be formed by applying light blocking paint to the entire cover part and then removing the paint around the connection receptacle. Therefore, the light may be transmitted only through the connection receptacle display part, increasing visibility of the connection receptacle display part.

The multimedia jack for a vehicle may further include a character display part with characters or symbols allowing a user to distinguish the multimedia port, the character display part is formed by removing the paint on the cover part from the characters and symbols. Moreover, the user may easily distinguish the multimedia port by the characters or the symbols since the light shines through the character display part. The cover part may include a reflector disposed at an inner side thereof so as to be coupled thereto, and the connection receptacle display part may be formed by exposing a portion of the reflector through the connection receptacle. Therefore, the light emitted from the LED lighting apparatus may enhance the visibility of the connection receptacle display part through the reflector.

The multimedia jack for a vehicle may further include a character display part with characters or symbols allowing a user to distinguish the multimedia port, the character display part is disposed at the reflector and is visible on the cover part. Therefore, the light emitted from the LED lighting apparatus may shine through the reflector allowing the user to distinguish the multimedia port by the characters and the symbols on the cover part.

The multimedia port may include a universal serial bus (USB) port and an auxiliary (AUX) port, and outer surfaces of the USB port and the AUX port may have port housings to prevent the light irradiated from the LED from leaking through the USB port and the AUX port. Therefore, the light may be blocked to prevent light from leaking through the USB port and the AUX port, such that the irradiated light only shines through the connection receptacle display part and the character display part.

An on and off function and a brightness control of the LED lighting apparatus may interwork with a lighting apparatus of the vehicle. Therefore, when using the multimedia jack at night or in dark lighting, the power and the brightness of each device are not separately controlled, but may be controlled simultaneously, increasing user convenience.

BRIEF DESCRIPTION OF THE DRAWINGS

The above and other objects, features and advantages of the present invention will now be more clearly understood from the following detailed description taken in conjunction with the accompanying drawings, in which.

DESCRIPTION OF PREFERRED EMBODIMENTS

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/of" includes any and all combinations of one or more of the associated listed items.

Hereinafter, the present invention will be described in detail with reference to the accompanying drawings.

Figure 1:
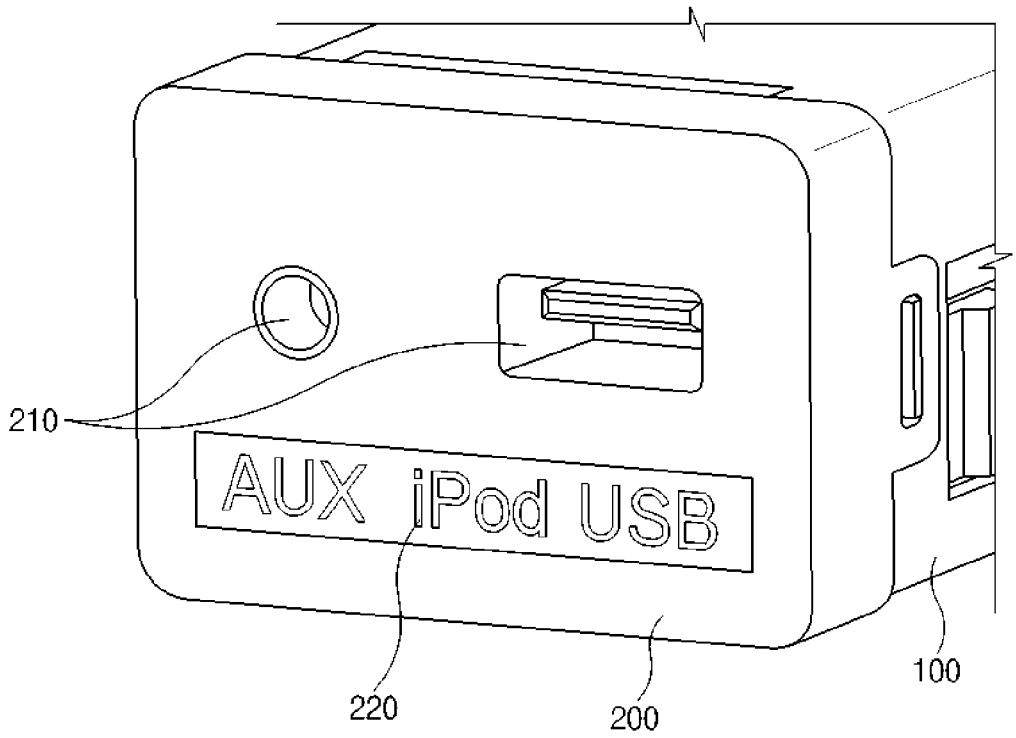
FIG. 1 is an exemplary view of a multimedia jack for a vehicle according to the related art.
Figure 2:
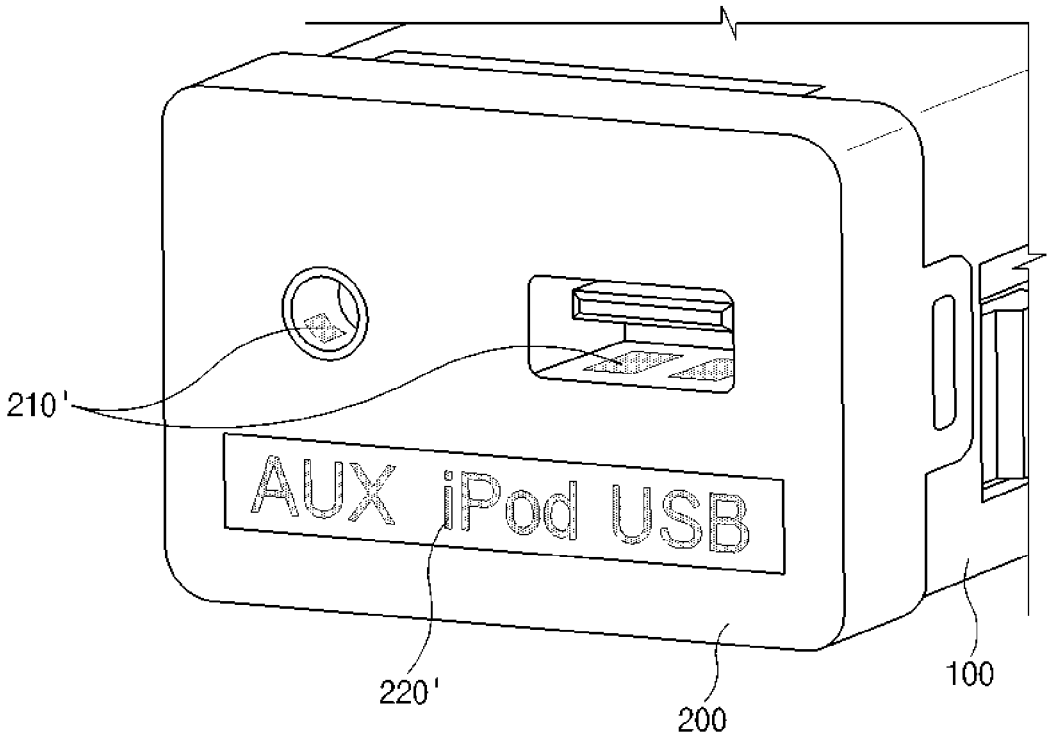
FIG. 2 is an exemplary view illustrating a light transmission form of the multimedia jack for a vehicle according to the related art.
Figure 3:
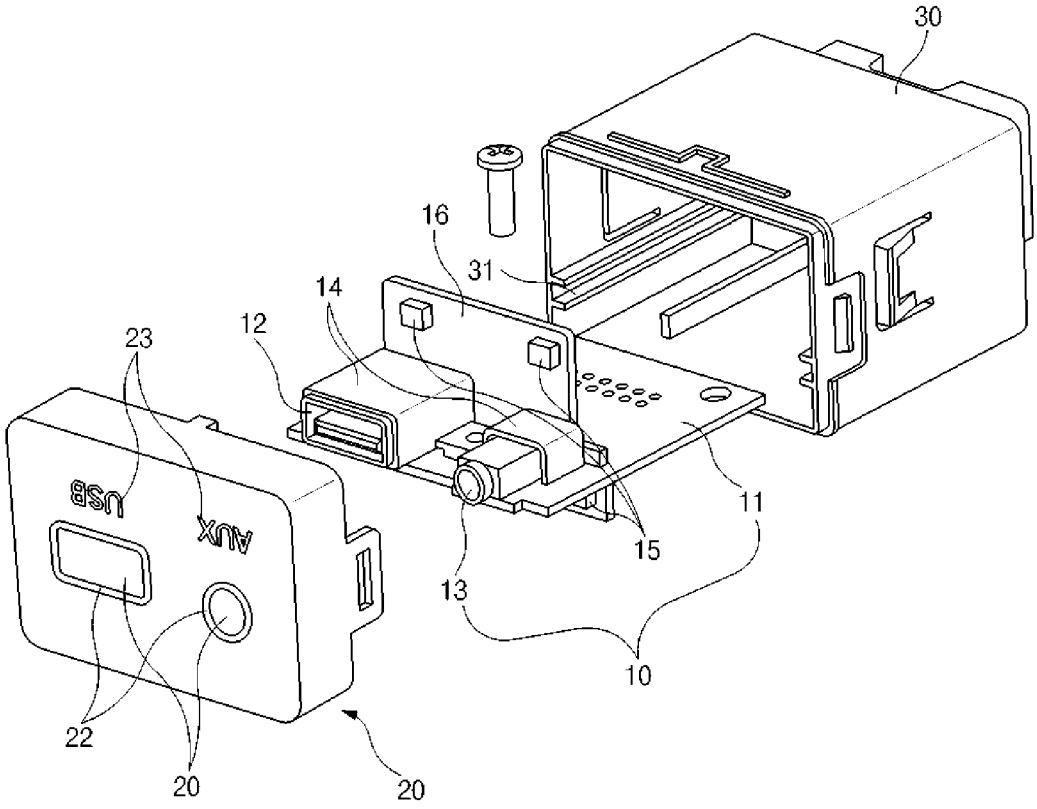
FIG. 3 is an exemplary view of a multimedia jack for a vehicle with a lighting apparatus illustrating a terminal part according to an exemplary embodiment of the present invention.
Figure 4:
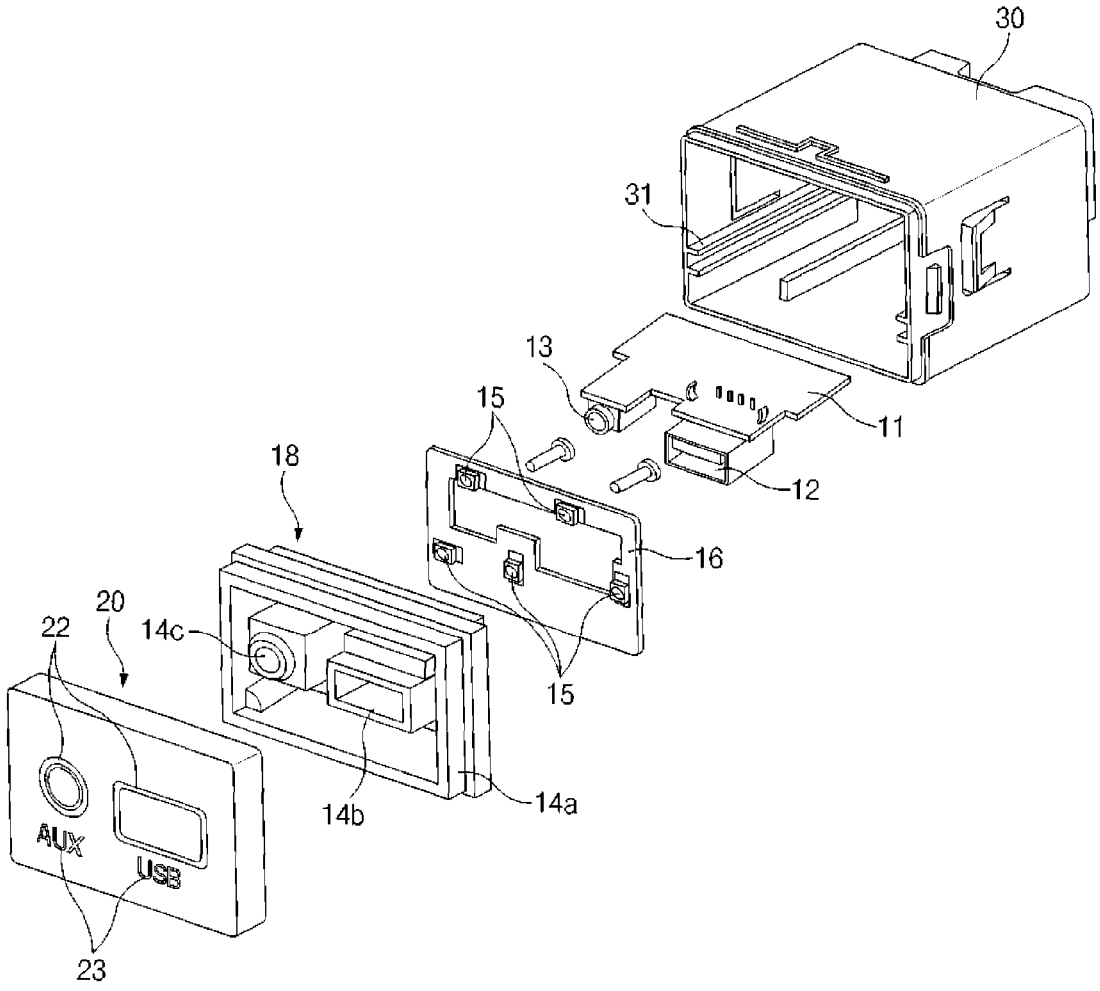
FIG. 4 is an exemplary view of a multimedia jack for a vehicle with a lighting apparatus illustrating a reflector according to an exemplary embodiment of the present invention.
Figure 5:
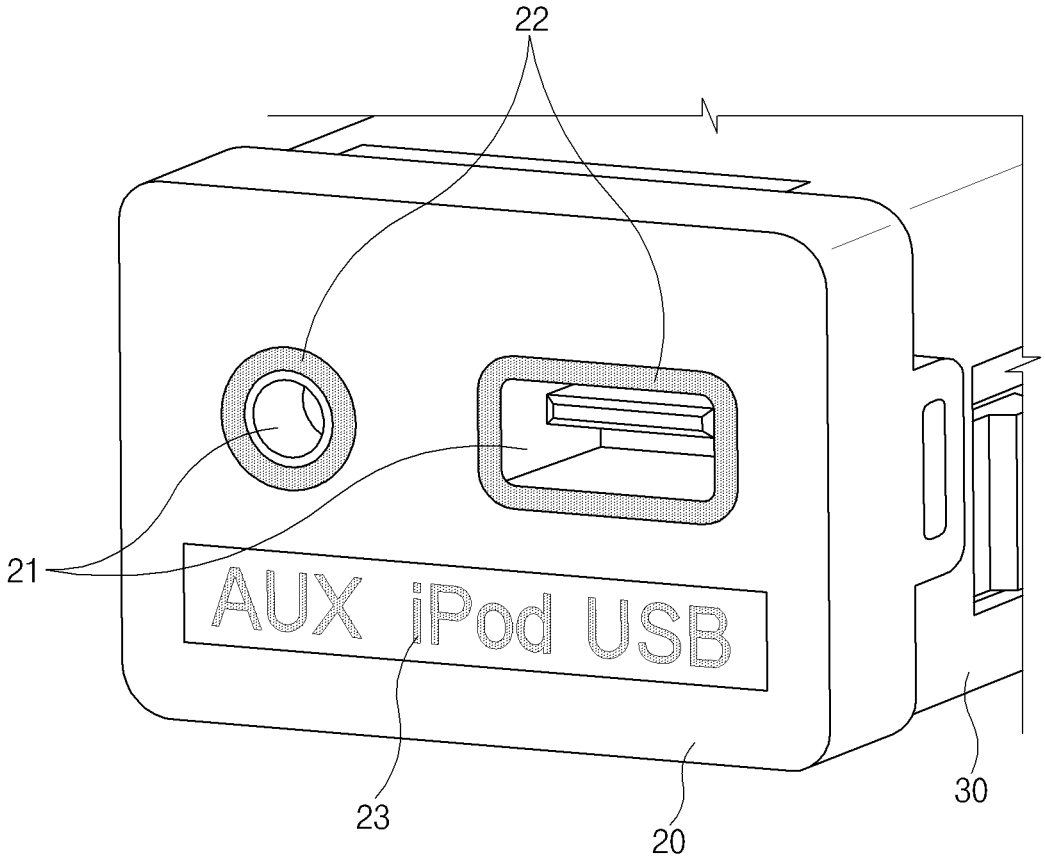
FIG. 5 is an exemplary view of a multimedia jack for a vehicle with a lighting apparatus illustrating a reflector according to an exemplary embodiment of the present invention.
Figure 6:
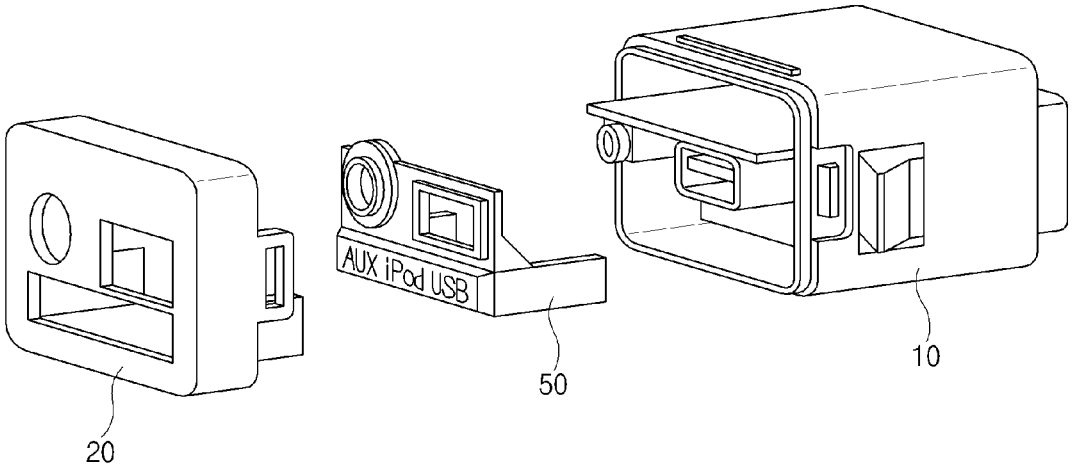
FIG. 6 is an exemplary view illustrating a light transmission form of the multimedia jack for a vehicle with the lighting apparatus according to an exemplary embodiment of the present invention.

FIG. 3 is an exemplary view of a multimedia jack for a vehicle with a lighting apparatus illustrating a terminal part according to a first exemplary embodiment of the present invention; FIG. 4 is an exemplary view of a multimedia jack for a vehicle with a lighting apparatus illustrating a reflector according to a second exemplary embodiment of the present invention; FIG. 5 is an exemplary view of a multimedia jack for a vehicle with a lighting apparatus illustrating a reflector according to a third exemplary embodiment of the present invention; and FIG. 6 is an exemplary view showing a light transmission form of the multimedia jack for a vehicle with the lighting apparatus according to the exemplary embodiment of the present invention.

As shown in FIGS. 3 to 5, the multimedia jack for a vehicle having the lighting apparatus according to the exemplary embodiment of the present invention, is configured to include a housing 30 with an opening part; a terminal part 10 disposed inside the housing 30; and a cover part 20 coupled to the housing 30, configured to cover the opening part of the housing 30.

The terminal part 10 includes a main printed circuit board (PCB) 11 on which electronic wire components are connected to each other in a circuit structure. The main PCB 11 is inserted and mounted in the housing 30. To this end, the housing 30 includes a mounting groove, and the main PCB 11 is inserted into the housing 30 and coupled to the mounting groove 31. In other words, both ends of the main PCB 11 are inserted into the mounting groove 31 to slide into the inside of the housing 30, enably coupling of the main PCB 11.

A universal serial bus (USB) port 12 and an auxiliary (AUX) port 13, to which multimedia devices may be connected, are coupled to the main PCB 11 and may be spaced apart from each other by a predetermined interval. The input portions of the USB port 12 and the AUX port 13, into which the multimedia devices are inserted and connected, are directed toward the front of the opening part of the housing 30.

The outer surfaces of the USB port 12 and the AUX port 13 include port housings 14 into which the USB port 12 and the AUX port 13 are inserted. The port housings 14 are formed to correspond to the shape of the USB port 12 and the AUX port 13 and are made of a light blocking material. Therefore, light emitted from a light emitting diode (LED) lighting apparatus 15 does not leak through the USB port 12 and the AUX port 13.

Another way to provide the port housings 14, the block out part 18 provided between the cover part 20 and the terminal part 10. The block out part 18 comprises a block out frame 14*a* equipped to the cover part 20; and the USB port housing 14*b* and the AUX pot housing 14*c* that are formed to be integrated with the block out frame 14*a* and are inserted into the USB port 12 and the AUX port 13, respectively. Therefore, light emitted from the LED lighting apparatus 15 does not leak through another crack as well as the USB port 12 and the AUX port 13.

An auxiliary PCB 16 may be coupled perpendicularly to the main PCB 11 and may be parallel to the opening part of the housing 30. The LED lighting apparatus 15 is mounted on the auxiliary PCB 16. It is preferable that a plurality of LED lighting apparatuses 15 are mounted and disposed adjacent to the USB port 12 and adjacent to the AUX port 13, respectively. In addition, it is preferable that the LED lighting apparatus 15 is also disposed at a position corresponding to a character display part 23 of a cover part 20 to be described on the auxiliary PCB 16.

The cover part 20 is coupled to the opening part of the housing 30 to protect the terminal part 10 that is mounted in the housing 30. Connection receptacles 21 are disposed on the cover part 20 corresponding to the USB port 12 and the AUX port 13 of the terminal part 10 so that the multimedia devices may be inserted into and connected to the USB port 12 and the AUX port 13. The connection receptacles 21 are formed in shapes corresponding to cross section areas of the USB port 12 and the AUX port 13. That is, the connection receptacle 21 corresponding to the USB port 12 may be perforated and substantially rectangular, and the connection receptacle 21 corresponding to the AUX port 13 may be perforated and substantially circular.

The cover part 20 includes connection receptacle display parts 22 along the edges of the connection receptacles 21. In addition, the cover part 20 includes the character display part 23 disposed at positions corresponding to the USB port 12 and the AUX port 13 below the connection receptacle display parts 22. However, the character display part 23 may be disposed adjacent to the connection receptacles 21 to be easily distinguished by the user. The light emitted from the LED lighting apparatus 15 shines through the connection receptacle display parts 22 and the character display part 23.

A method for forming the connection receptacle display part 22 and the character display part 23 according to the first exemplary embodiment of the present invention will be described with reference to FIG. 3. First, light blocking paint is applied to the entire cover part 20, made of a substantially transparent or semi-transparent material. Then, the paint is removed at edges of the connection receptacles 21 and from the shapes of characters and symbols to allow the light to be transmitted through portions in which the paint is removed. Therefore, the connection receptacle display parts 22 are formed along the edges of the connection receptacles 21 where the paint is removed, and the character display part 23 is formed at the characters and the symbols. However, the connection receptacle display part 22 and the character display part 23 may also be formed by other methods. For example, the connection receptacle display part 22 and the character display part 23 may be engraved form from the cover part 20 with no paint applied or may be formed by being embossed from the cover part 20 whereby only paint at the embossed portion need be removed.

A method for forming the connection receptacle display part 22 and the character display part 23 according to the second exemplary embodiment of the present invention will be described with reference to FIG. 4. A reflector 50 may be detachably coupled to the cover part 20. The reflector 50 includes receptacles having a shape corresponding to the connection receptacle 21 through which the multimedia devices are inserted 21 to the USB port 12 and the AUX port 13. The reflector 50 may be partially exposed through the connection receptacles 21 of the cover part 20 to define the connection receptacle display parts 22. In addition, to form the character display part 23, a portion under the connection receptacle of the cover part 20 may be perforated. The reflector 50 includes characters and symbols, through which light is transmitted to illuminate the characters and symbols. Therefore, a portion of the mounted reflector 50 is exposed to the outside of the cover part 20 through a space formed by perforating a portion under the connection receptacles 21 of the cover part 20, and the light is blocked around the characters and the symbols. As another method, the character display part 23 and the connection receptacle display part 21 may be formed by protruding the characters and the symbols from the reflector 50 and perforating the cover part 20 into shapes of the characters and the symbols so that only the characters and the symbols of the reflector 50 are exposed. However, the character display part 23 and the connection receptacle display part 21 are not necessarily limited to being formed by the above-mentioned method, but may be formed by other methods as long as the light of the reflector 50 may shine to the outside of the cover part 20, thereby distinguishing the characters, the symbols, and the connection receptacles 21 in the cover part 20.

Referring to FIG. 5, the multimedia jack formed by the above-mentioned configurations and methods transmits the light emitted from the LED lighting apparatus 15 through the connection receptacle display parts 22 when used at night or in dark lighting. Therefore, the connection receptacle display parts 22, through which the light shines, allow the user to easily recognize positions, sizes, and shapes of the connection receptacles 21. In addition, since the user may read the characters of the character display part 23, he/she may more easily distinguish the connection receptacles 21. Further, portions of the terminal part 10 and the cover part 20 are configured to block light, thereby increasing brightness uniformity of the connection receptacle display parts 22 and the character display part 23.

In addition, to further increase user convenience, the LED lighting apparatus 15 may be configured to interwork with other apparatuses of the vehicle. A signal controlling power and brightness operation of the LED lighting apparatus 15 may be configured to interwork with a light control signal that controls the lights of the vehicle. Moreover, the user may connect a switch that may transmit a signal capable of controlling the power and the brightness of the lighting apparatus to the lighting apparatus in the multimedia jack, thereby allowing the user to operate and control each apparatus at night or in dark lighting simultaneously. However, the LED lighting apparatus 15 is not necessarily limited to interworking with the lighting apparatus of the vehicle, but may interwork with other apparatuses of the vehicle, for example, the air conditioning apparatus, an audio apparatus, and the like.

As set forth above, according to the exemplary embodiment of the present invention, a multimedia jack for a vehicle is disclosed with a lighting apparatus capable of increasing user convenience at night or in dark lighting, providing uniform lighting, and controlling the power and the brightness by interworking with other apparatuses in the vehicle.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A multimedia jack for a vehicle including a lighting apparatus, comprising:

a housing including an opening part;

a terminal part, mounted on an inner side of the housing, including a multimedia port and a light emitting diode (LED) lighting apparatus;

a cover part covering the opening part of the housing and including a connection receptacle disposed at a position corresponding to the multimedia port; and a connection receptacle display part disposed around the connection receptacle, wherein light irradiated from the LED lighting apparatus shines through the connection receptacle display part.

2. The multimedia jack for a vehicle of claim 1, wherein the connection receptacle display part is formed by applying light blocking paint to the entire cover part and removing the light blocking paint around the connection receptacle.

3. The multimedia jack for a vehicle of claim 2, further comprising a character display part including characters or symbols configured to allow a user to distinguish the multimedia port, wherein the character display part is formed by removing the light blocking paint at the cover part.

4. The multimedia jack for a vehicle of claim 1, wherein the cover part further comprises a reflector coupled to an inner side of the cover part, wherein the connection receptacle display part is formed by exposing a portion of the reflector through the connection receptacle.

5. The multimedia jack for a vehicle of claim 4, further comprising a character display part including characters or symbols configured to allow a user to distinguish the multimedia port, wherein the character display part is disposed at the reflector and is formed by being exposed from the cover part.

6. The multimedia jack for a vehicle of claim 1, wherein the multimedia port includes a universal serial bus (USB) port and an auxiliary (AUX) port, and outer surfaces of the USB port and the AUX port include port housings configured to prevent the light irradiated from the LED from leaking through the USB port and the AUX port, respectively.

7. The multimedia jack for a vehicle of claim 1, wherein the multimedia port includes a universal serial bus (USB) port and an auxiliary (AUX) port, and further includes a block out part provided between the terminal part and the cover part and configured to prevent the leaking of the light irradiated from the LED lighting, and the block out part comprises a block out frame, and a USB port housing and a AUX port housing that are formed to be integrated with the block out frame and are inserted into the USB port and AUX port, respectively.

8. The multimedia jack for a vehicle of claim 1, wherein a power and a brightness control of the LED lighting apparatus interworks with a lighting apparatus of the vehicle.

* * * * *